US006092339A

United States Patent [19]

Hall et al.

[11] Patent Number: 6,092,339

[45] Date of Patent: Jul. 25, 2000

[54] EAVESTROUGHING SYSTEM

[76] Inventors: Julie E. Hall; S. Warren Hall, both of 3 Cranleigh Ct., Etobicoke, Ontario, Canada, M9A 3Y2

[21] Appl. No.: 09/114,161

[22] Filed: Jul. 13, 1998

[51] Int. Cl.[7] ..... E04D 13/072

[52] U.S. Cl. ..... 52/11; 52/12; 52/15; 248/48.1; 248/48.2

[58] Field of Search ..... 52/11, 12, 15, 52/14; 248/48.1, 48.2

[56] References Cited

U.S. PATENT DOCUMENTS

| | | | |
|---|---|---|---|
| 3,436,878 | 4/1969 | Singer | 248/48.1 |
| 3,545,144 | 12/1970 | Sickler | 52/11 |
| 3,752,428 | 8/1973 | Trostle et al. | 248/48.2 |
| 4,622,785 | 11/1986 | Miller | 52/11 |

FOREIGN PATENT DOCUMENTS

| | | | |
|---|---|---|---|
| 481818 | 4/1992 | European Pat. Off. | 52/11 |
| 511758 | 11/1992 | European Pat. Off. | 52/11 |
| 3-36353 | 2/1991 | Japan | 52/11 |
| 4-93452 | 3/1992 | Japan | 52/11 |

*Primary Examiner*—Carl D. Friedman
*Assistant Examiner*—Winnie Yip

[57] ABSTRACT

The present invention provides a simple two position mounting and installation system for eavestroughing. The system is designed to provide a spring retention system using the flexibility and rigidilty of the components. The system uses a retaining member and or a gutter having spring arms to provide the spring retention system. This system normally provides an over center type securement. The invention is also directed to a two position support arrangement between a facia mounted retainer and a modified gutter.

9 Claims, 2 Drawing Sheets

4
2
x
24
6
26
46
44
27
28
42
20

24
28
22
20

44
24
25
26
46
27
8
20
51

EAVESTROUGHING SYSTEM

FIELD OF THE INVENTION

The present invention relates to eavestrough systems and improvements in mounting and installation thereof.

BACKGROUND OF THE INVENTION

There are many eavestroughing systems in both aluminum and vinyl or other materials which are designed to allow a home owner or builder to easily install the eavestroughing. Installation of eavestroughing is somewhat difficult, primarily due to the fact that it is installed at a substantial height above ground and often requires a person or people to continuously move ladders.

The present invention teaches a system which is more convenient to install.

Rolled aluminum eavestroughing as well as combination facia and eavestroughing systems are well known, however, there are many applications where eavestroughing is retrofitted or a do-it-yourselfer installs a new eavestrough system. There are existing plastic or vinyl systems where a series of hooks are screwed or otherwise attached to a wood facia at selected points along the facia normally approximately every three feet. The eavestroughing is designed to engage these hooks and be suspended therefrom. There are also systems where a retaining member is secured to the facia and is generally continuous and the rear edge of the eavestroughing is hung from this member. Spacers or stays then engage this member to provide support for the front lip of the eavestroughing.

With aluminum systems, the most common approach is merely to position the aluminum trough at the appropriate height and secure the same by a nail passing through the front facia of the eavestrough and out the back face into the facia.

The present invention provides an alternative and more convenient way for securing of eavestroughing and the related parts thereof.

SUMMARY OF THE INVENTION

The present invention uses a continuous retaining member which is secured to the facia at the appropriate height. This retainer member has a rear mounting plate attached to the facia and has an outwardly and downwardly projecting spring arm which defines a locating cavity between the spring arm and the mounting plate. The rear edge of the eavestrough also has a spring arm which projects inwardly into the trough and in one position of the eavestrough, which is a non-working position of the eavestrough, the arm can easily be inserted and partially captured in and supported by the cavity of the retaining member. The eavestrough can then be rotated the necessary angle and is more positively retained in the mounting member. Preferably, a spring-type action maintains the eavestrough in the operation position.

Spacers or stays can then be inserted at appropriate positions along the length of the eavestrough. These stays have a rear portion which also snaps fit with the retaining member and also acts as a reinforcing member stiffening the now trapped spacer spring arm of the eavestrough and the spring arm of the retaining member.

In a preferred embodiment of the invention, the cavity of the retaining member is oversized at the top thereof and/or the spring arms cooperate such that a joining member can also be partially captured within the cavity. Such joining members are used to join two lengths of eavestroughing and typically, are on the outside of the eavestroughing. The spring arm of the eavestrough in combination with the spring arm of the retaining member sufficiently distort to provide the additional spacing for the joiner to be captured in a similar manner.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
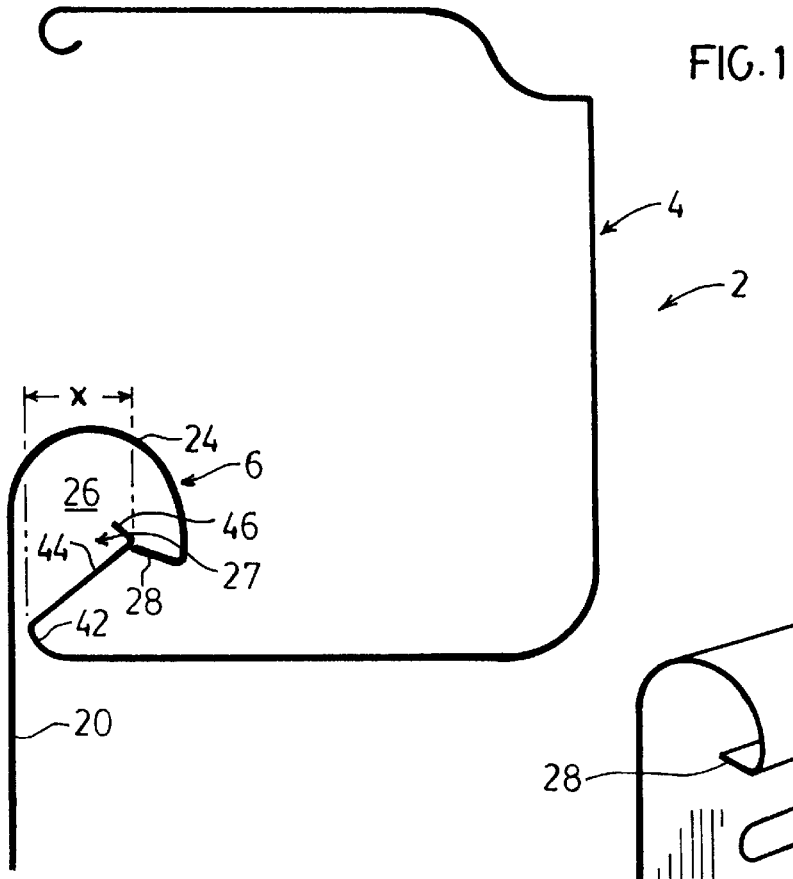
FIG. 1 is a cross-sectional view showing an eavestrough section and a retaining member in a non-operating position with the eavestrough about to be loosely captured in the retaining member.

The eavestrough system 2 is made up of the gutter 4, a retainer 6, which is secured to a building facia 8. As can be appreciated, the retainer 6 is preferably continuous as generally shown in FIG. 1*a* or can be mounted in a series of strips at desired locations along a facia. The preferred embodiment is that it is mounted to the facia, generally along the length thereof. This retaining member has a mounting plate 20 which overlies the facia with a series of ports 22 which are slotted-like openings to allow for thermal expansion. A fastener, such as a nail or screw, is used at desired points to pass through the ports 22 and engage the facia 8. In this way, the retaining member 6 is secured to the facia and it will also generally set the desired angle for draining along the length of the eavestrough.

The eavestrough section 4 is generally of any desired front profile and width, however, the back wall 40 has a rear top edge 42 with an inwardly extending spring arm 44 with a cam edge 46 at the free edge thereof. This inwardly extending spring arm 44 cooperates with the spring arm 24 of the retaining member 6.

Figure 2:
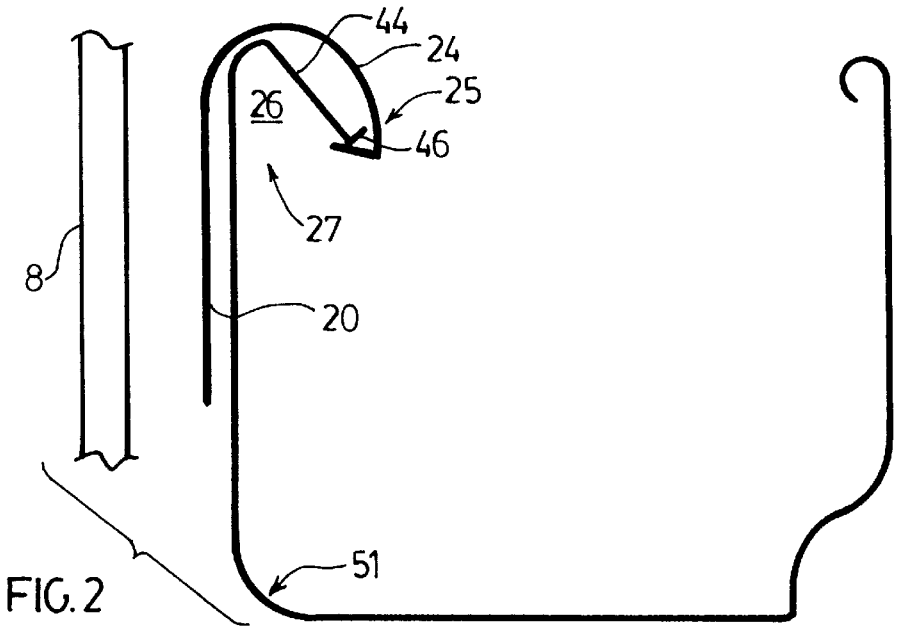
FIG. 2 is a sectional view showing an eavestrough in an operating position supported at the rear edge by the retaining member.

The retaining member 6 has the outwardly extending spring arm 24 and at the lower free edge thereof, includes a rearwardly extending lip 28. 24 and 28 will provide a spring-type action urging the eavestrough to the operating position as shown in FIG. 2.

Figure 1A:
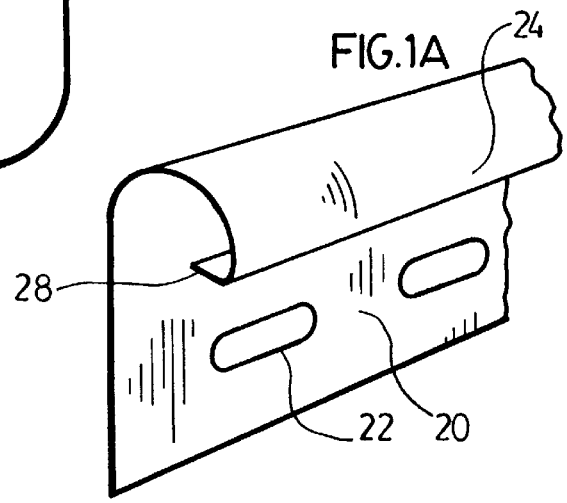
FIG. 1*a* is a partial perspective view of the retaining member.

As shown in FIG. 1, the eavestrough is rotated to a non-operating position, in this case 90° from the operating position of FIG. 2, and in this position, the spring arm 44 can easily move past the rearwardly extending lip 28 and enter the cavity 26 defined between the spring arm 24 and the mounting plate 20. The cavity 26 does have a restricted mouth 27 and there can be some interference if desired, resulting in camming of the spring arms to allow the eavestrough to move into the cavity 26. Once it is moved into position, it can be appreciated that it can be released and gravity will tend to maintain the inwardly extending spring arm in the cavity 26 as it is captured behind the rearwardly extending lip 28 of the retaining member. Basically, the eavestrough cooperates with the retaining member to provide an overcentre-type latch. This is best understood with respect to FIG. 2. In the operating position of FIG. 2, the eavestrough is merely rotated downwardly and this produces a temporary distortion of spring arm 24 and a temporary distortion of spring arm 44 to allow the eavestrough to move past the centre position and now be spring-biased to the operating position of FIG. 2. The cam edge 46 of the eavestrough is engaged at position 25 with the spring arm 24 and these cooperate to urge the bottom eavestrough 51 generally into engagement with the mounting plate 20 or the facia 8. The cavity 26 and the spring arms 24 and 44 do allow for additional distortion as will be required for receiving of the spacer shown in FIG. 3 and the joining member shown in FIG. 4.

Figure 3:
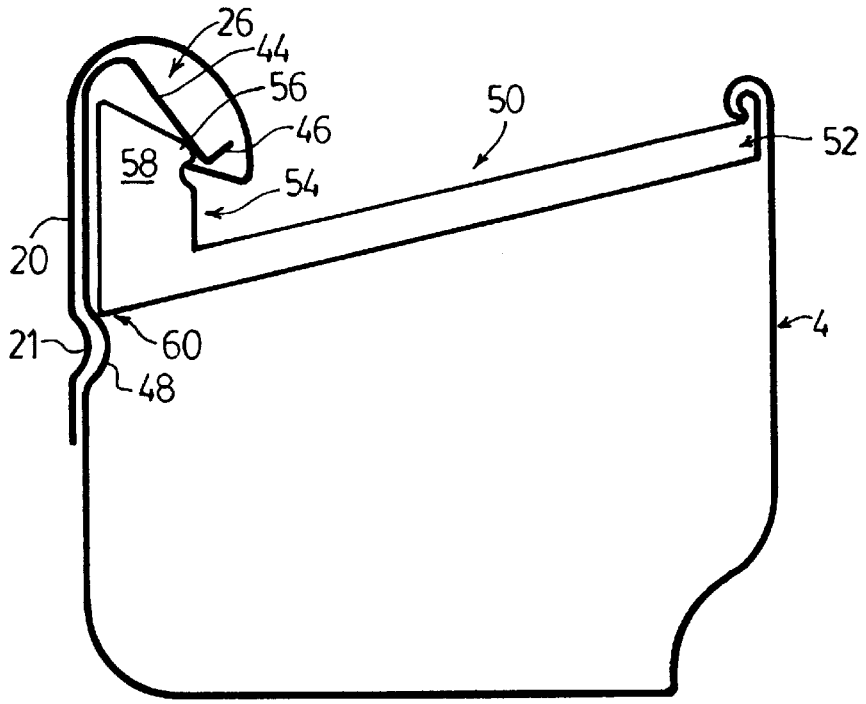
FIG. 3 is a sectional view showing a spacer or retainer captured at the rear edge of the eavestroughing and supported by the retaining member and it also shows a modification of the retaining member and the rear wall of the eavestrough.

Turning to FIG. 3, it can be seen that a hook or spacer 50 which preferably is an injected molded piece and only provided certain positions in the length of the eavestrough, perhaps every three or four feet, supports the front edge of the gutter 4 and extends rearwardly and engages the back wall 40 of the eavestrough. The hook 50 includes an upwardly extending spacer 58 which provides a snug fit further tensioning the spring arms 24 and 44. This spacer 58 includes an inwardly extending latch portion 56 which engages the edge of the rearwardly extending lip 28, thus the spacer is hooked to the retainer 6 and it further serves to reinforce and strengthen the interaction of the eavestrough section and the retaining member.

FIG. 3 also shows how the rear wall of the eavestrough can include an inward projection 48 which provides a bottom stop for the lower edge 60 of the hook 50. With this arrangement, any force on the front of the eavestrough for general loading of the eavestrough tends to urge the eavestrough into engagement with the facia member and it also provides a very stiff upper portion due to the rigidity of the hook 50 and its engagement with the various members. FIG. 3 also shows how the mounting plate 20 can include an inward projection 21 for providing a further lock-type fit with the inward projection 48 of the rear of the eavestrough.

With this arrangement, thermal expansion of the eavestrough and the retainer should be generally the same, however, if there is any difference, the eavestrough can move in the length of the retainer due to a slide-type fit.

Figure 4:
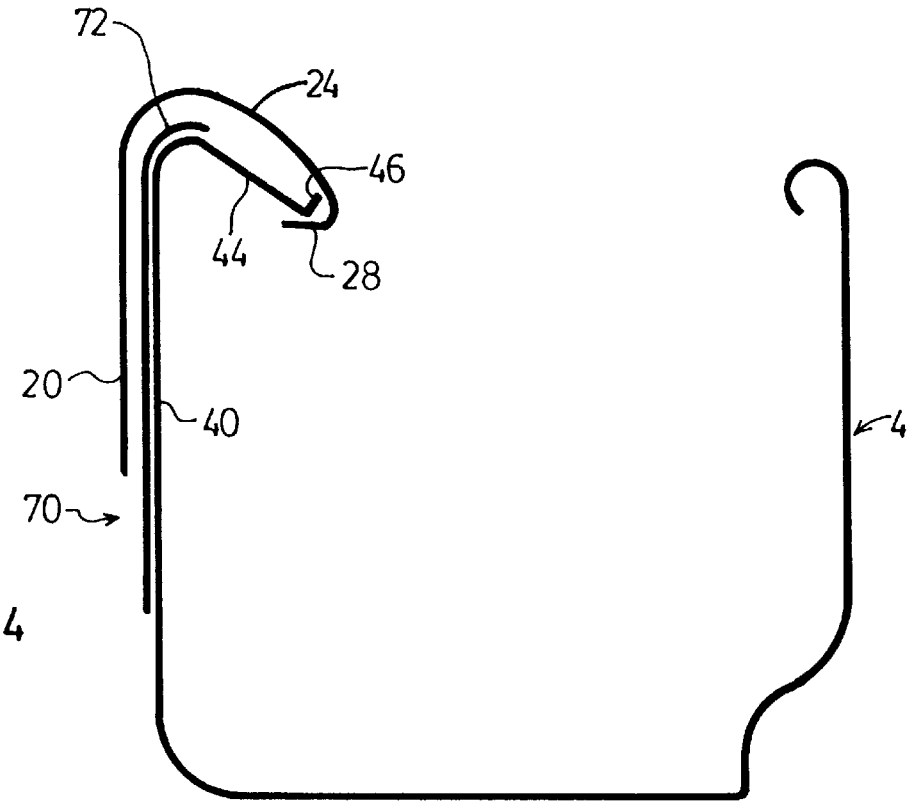
FIG. 4 is a sectional view showing how the retaining member can accommodate the additional width required by a joiner applied about the outside of the eavestrough.

FIG. 4 shows the example of an eavestrough section having a joiner 70 applied about the outer edges thereof. This joiner has additional thickness, however, it is still desirable to accommodate the joiner 70 within the retainer 6. The cavity 26 can be sized to allow for this preparation and this additional space is accomplished by an bowing upwardly of the spring arm 24 and then upward distortion of the spring arm 44 of the eavestrough section. This distortion in combination with the oversizing of a cavity accommodates the joiner. It should be noted that the joiner preferably at either end thereof, does not extend fully inwardly to engage the rearwardly extending lip 28 or at least overly therewith. It is possible to accommodate this if desired but it does not seem to be necessary.

In a manner similar to FIG. 4, it is also possible to support a downspout unit from the retainer 6. Such a downspout typically has the eavestrough section freely slidable therein and therefore, the rear of the downspout can have a centre clear section with a spring-type arm similar to spring arm 44 for engaging the retaining member and cooperating therewith. In this way, support for the downspout, if desired, can also be accomplished. The retaining member as described above, allows for easy installation in that the retainer member is merely secured at appropriate places along the facia and the various components of the system can be supported by the retainer.

The present system has been particularly described with respect to a vinyl eavestroughing system, however, it is suitable for metal or other materials where the desirable overcentre-type latch arrangement can be provided, if desired.

It can also be appreciated that locking in the operating position could also be provided by inserting a retainer in the portion of the cavity, once the eavestrough section has moved to the operating position. This has not been found to be necessary but is another way to provide a snug-type fit.

The system as shown allows for easy installation in that it has a first position where it is generally supported to allow the installer the convenience to make adjustments, etc., and then, it can finally be moved to a finished position. The concept preferably works due to a rotation and overcentre-type latch, but in a more general principle, has a first loose-type support arrangement and movable to a second operating position.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property of privilege is claimed are defined as follows:

1. An eavestrough system comprising a retainer member for attachment to a facia and a gutter supported by said retainer member, said retainer member comprising a mounting plate for attachment to said facia and an outwardly extending spring arm defining a securing cavity, said gutter including a channel shaped section having a front wall and a rear wall with said rear wall having an upper edge with a spring arm which extends into the channel shaped section, said spring arms cooperating in an interference relationship in a first position of said gutter to loosely support said gutter from said retainer with said rear wall being outwardly and downwardly angled relative to said mounting plate, said gutter being movable to a second position where said gutter is secured and held in the operating position of the gutter with said spring arms cooperating to create a bias force maintaining said gutter in said second position, said spring arm of said gutter in said first position being restricted by said spring arm of said mounting plate and opposing movement towards said second position.

2. A system as claimed in claim 1 wherein said gutter cooperates with said retainer in said operating position to define an over center spring latch therewith.

3. An eavestrough system comprising a retainer member for attachment to a facia and a gutter supported by said retainer member, said retainer member comprising a mounting plate for attachment to said facia and an outwardly extending spring arm defining a securing cavity, said gutter including a channel shaped section having a front wall and a rear wall with said rear wall having an upper edge with a spring arm which extends into the channel shaped section, said spring arms cooperating in an interference relationship in a first position of said gutter to loosely support said gutter from said retainer with said rear wall being outwardly and downwardly angled relative to said mounting plate, said gutter being movable to a second position where said gutter is secured and held in the operating position of the gutter with said spring arms cooperating to create a bias force maintaining said gutter in said second position, wherein said securing cavity is sized to additionally receive and retain one end of a hook spacer arm with the other end of the hook spacer arm supporting the front top edge of the gutter.

4. A system as claimed in claim 3 wherein said securing cavity is sized to additionally receive and retain part of a joiner secured to the outer periphery of said gutter.

5. An eavestrough system comprising a retainer member for attachment to a facia and a gutter supported by said retainer member, said retainer member comprising a mounting plate for attachment to said facia and an outwardly extending spring arm defining a securing cavity, said gutter including a channel shaped section with a rear wall having a upper edge with a spring arm extending from said upper edge into said channel shaped section, said spring arms cooperating in a first position of said gutter to loosely support said gutter from said retainer member with said gutter disposed at an angle such that said rear wall extends downwardly and outwardly away from said mounting plate, said spring arms in said first position being in engagement and opposing a gravity bias force of said eavestrough urging movement of said gutter towards a second position where said rearwall is generally parallel to said mounting plate, said spring arms resiliently distorting during movement between said first and said second position and cooperating in said second position to oppose movement of said eavestrough back to said first position.

6. A system as claimed in claim 5 wherein said securing cavity is oversized and said cavity and said spring arms cooperate to additionally retain one end of a hook spacer with the other end of the hook spacer supporting a front top edge of the gutter.

7. A system as claimed in claim 6 wherein said securing cavity is oversized and said cavity and said spring arms cooperate to additionally retain part of a joiner secured to the outer periphery of said gutter.

8. A system as claimed in claim 5 wherein said spring arms cooperate in said second position to produce a bias force urging movement towards said second position such that an over center spring latch relationship is defined therebetween.

9. A system as claimed in claim 5 wherein said spring arms during movement between said first and said second positions resiliently distort to initially produce a bias force urging movement towards said first position and after sufficient movement produce a bias force urging movement towards said second position.

* * * * *